US006639184B1

(12) United States Patent
Ennis

(10) Patent No.: US 6,639,184 B1
(45) Date of Patent: Oct. 28, 2003

(54) CORDLESS CURLING IRON HEATING SYSTEM

(76) Inventor: Pauline M. Ennis, 761 Avenue A #7, Bayonne, NJ (US) 07002

( * ) Notice: Subject to any disclaimer, the term of this patent is extended or adjusted under 35 U.S.C. 154(b) by 0 days.

(21) Appl. No.: 10/164,802

(22) Filed: Jun. 7, 2002

(51) Int. Cl.[7] ..... A45D 1/04

(52) U.S. Cl. ..... 219/222; 219/242; 219/225

(58) Field of Search ..... 219/222, 242, 219/225, 240, 521, 480, 476, 477, 506; D28/38; 132/227–232

(56) References Cited

U.S. PATENT DOCUMENTS 1,579,476 A * 4/1926 Dominguez ..... 219/428
3,250,895 A 5/1966 Mc Nair
3,304,141 A * 2/1967 Rogers ..... 312/45
3,892,943 A 7/1975 Van Droogenbroek
3,946,196 A * 3/1976 Waters et al. ..... 219/222
4,101,756 A 7/1978 Yamano
4,103,145 A * 7/1978 Oliveri ..... 219/222
5,054,615 A 10/1991 Stillwagon et al.
D326,164 S 5/1992 Taylor
5,648,004 A 7/1997 Simpson
5,676,871 A 10/1997 Graves
5,749,379 A 5/1998 Stillwagon
D404,523 S * 1/1999 Lucier ..... D28/38
D410,111 S * 5/1999 Henry ..... D28/38
D467,390 S * 12/2002 Lewis ..... D28/73

* cited by examiner

*Primary Examiner*—Teresa Walberg
*Assistant Examiner*—Vinod D. Patel

(57) ABSTRACT

A cordless curling iron heating system for facilitating the efficient use of multiple sized curling irons. The cordless curling iron heating system includes a housing which includes a plurality of curling iron sockets, each one of a plurality of heating elements coupled to an associated one of the plurality of curling iron sockets for heating the associated curling iron socket, and a plurality of cordless curling irons which are insertable into a desired one of the curling iron sockets for heating.

12 Claims, 4 Drawing Sheets

48
THERMOSTATS
HEATING ELEMENTS
50
LCD DRIVER
LCD DISPLAY
MICROCONTROLLER
KEYBOARD
40
38
42
46

70
24
20
66
66
68
68
ON
OFF
1
2
3
4
5
6
7
8
0

CORDLESS CURLING IRON HEATING SYSTEM

BACKGROUND OF THE INVENTION

1. Field of the Invention

The present invention relates to curling iron stations and more particularly pertains to a new cordless curling iron heating system for facilitating the efficient use of multiple sized curling irons.

2. Description of the Prior Art

The use of curling iron stations is known in the prior art. U.S. Pat. No. 5,054,615 describes a system for organizing and heating multiple curling irons. Another type of curling iron stations is U.S. Pat. No. 4,101,756 having a stand for multiple electric curling irons.

While these devices fulfill their respective, particular objectives and requirements, the need remains for a system that includes certain improved features such as individual on/off switching, digital temperature control, and efficient layout for multiple size curling irons.

SUMMARY OF THE INVENTION

The present invention meets the needs presented above by incorporating multiple sockets for receiving cordless curling irons and multiple heating elements.

Still yet another object of the present invention is to provide a new cordless curling iron heating system that allow thirteen different sizes to be used contemporaneously.

Even still another object of the present invention is to provide a new cordless curling iron heating system that fits efficiently into a standard cosmetology work station.

To this end, the present invention generally comprises a housing which includes a plurality of curling iron sockets, each one of a plurality of heating elements coupled to an associated one of the plurality of curling iron sockets for heating the associated curling iron socket, and a plurality of cordless curling irons which are insertable into a desired one of the curling iron sockets for heating.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
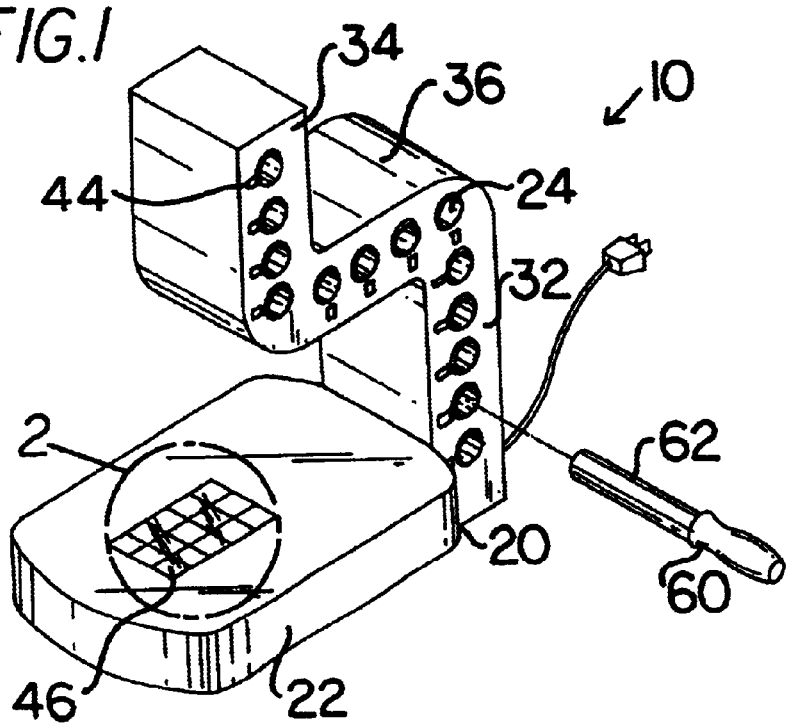
FIG. 1 is a schematic perspective view of a new cordless curling iron heating system according to the present invention.
Figure 2:
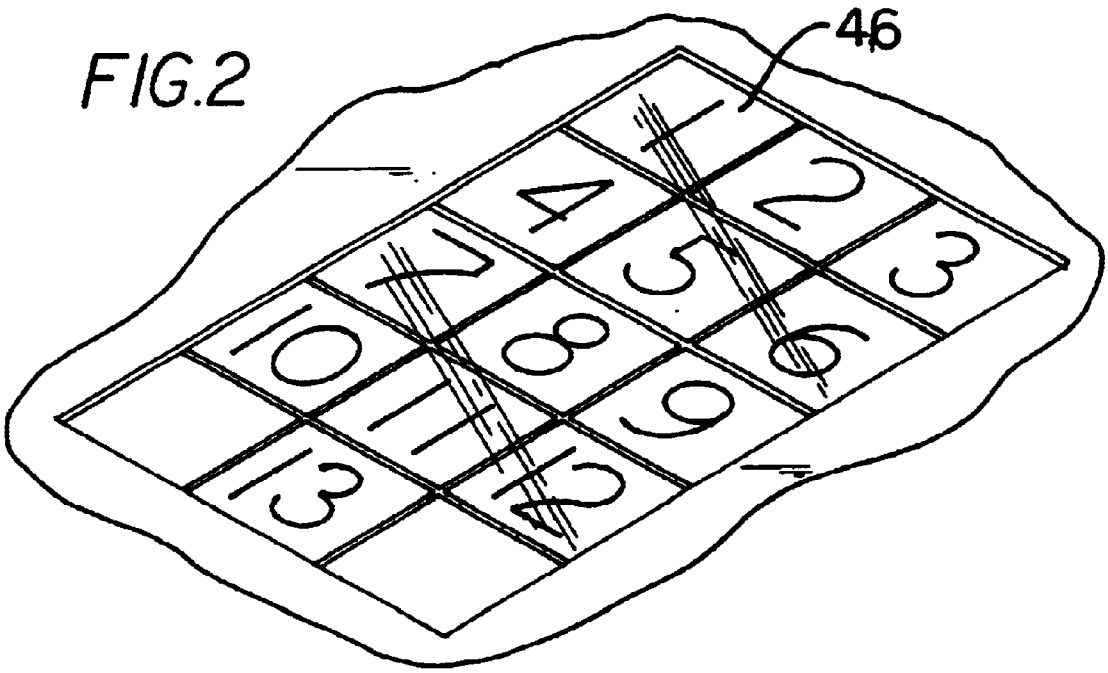
FIG. 2 is a schematic detail view of area 2 of FIG. 1 of the present invention.
Figure 3:
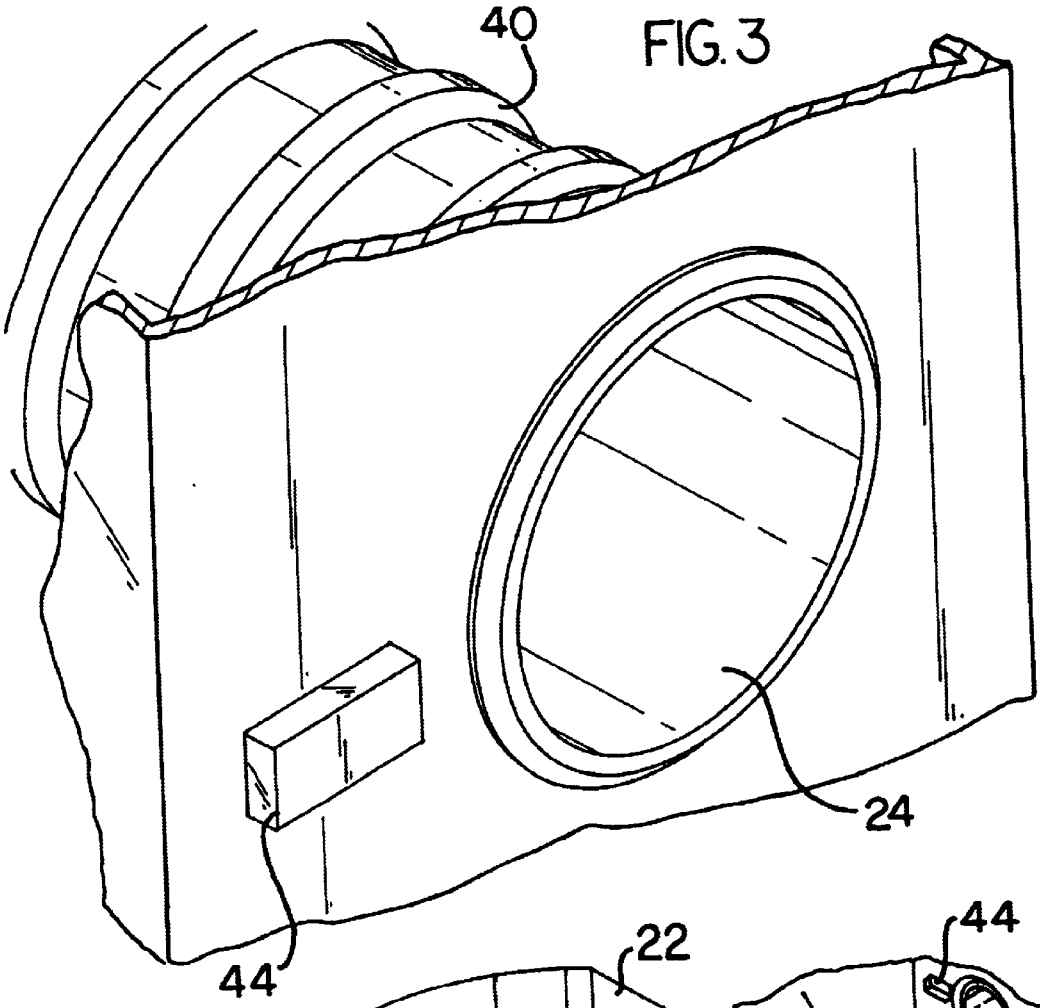
FIG. 3 is a schematic detail view of the curling iron socket portion of the present invention.
Figure 4:
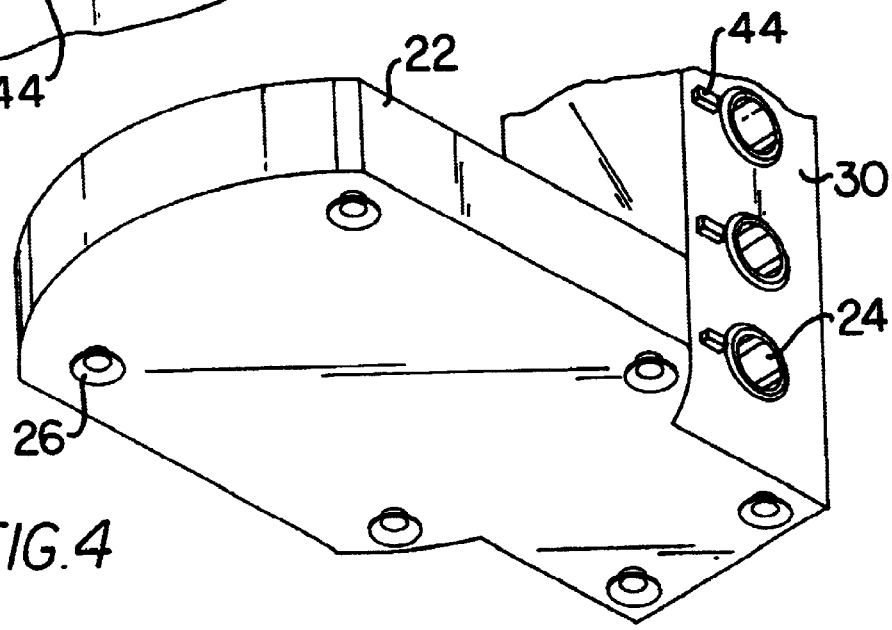
FIG. 4 is a schematic bottom view of the base of the present invention.
Figure 5:
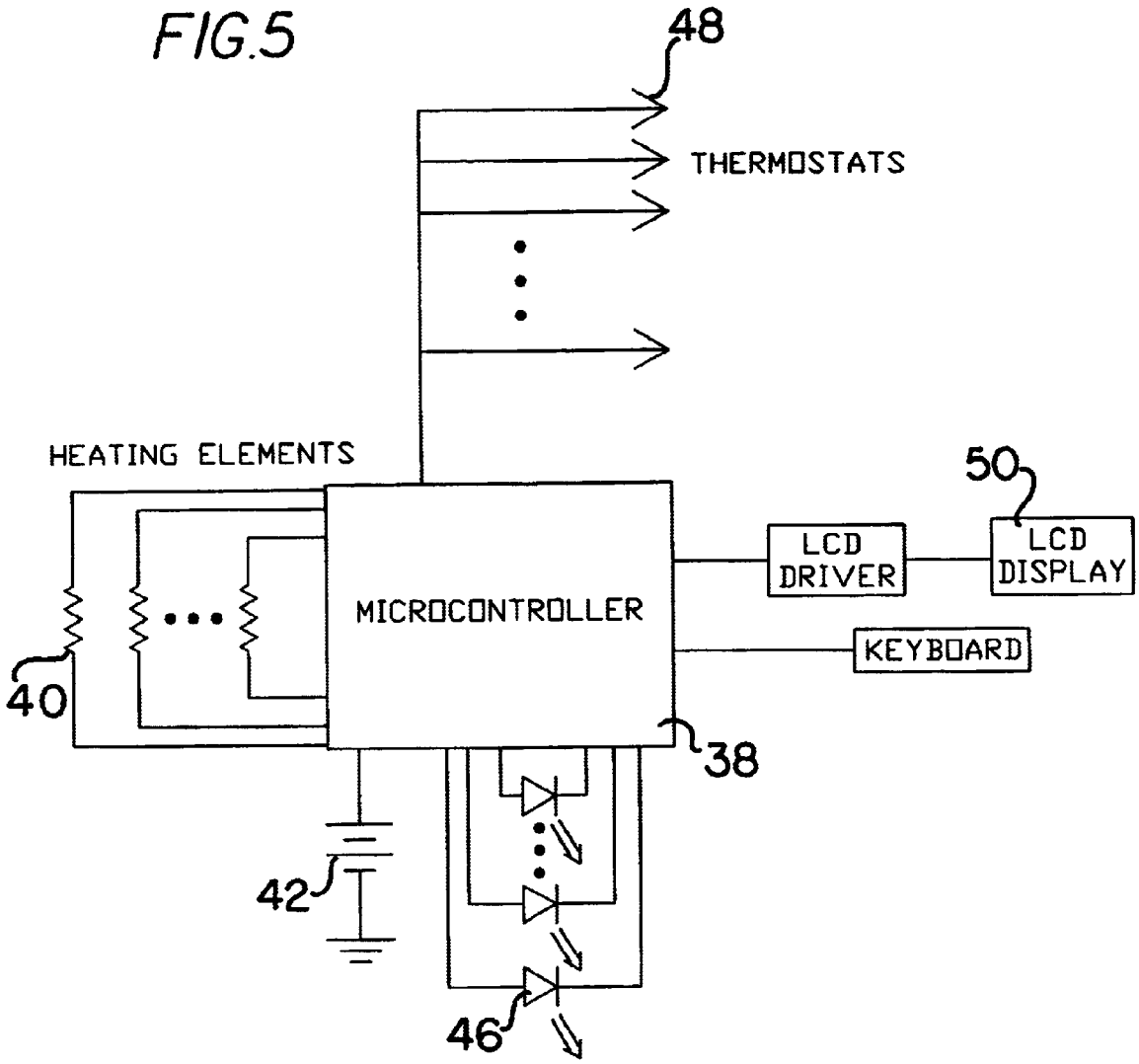
FIG. 5 is a schematic functional interconnect view of the present invention.
Figure 6:
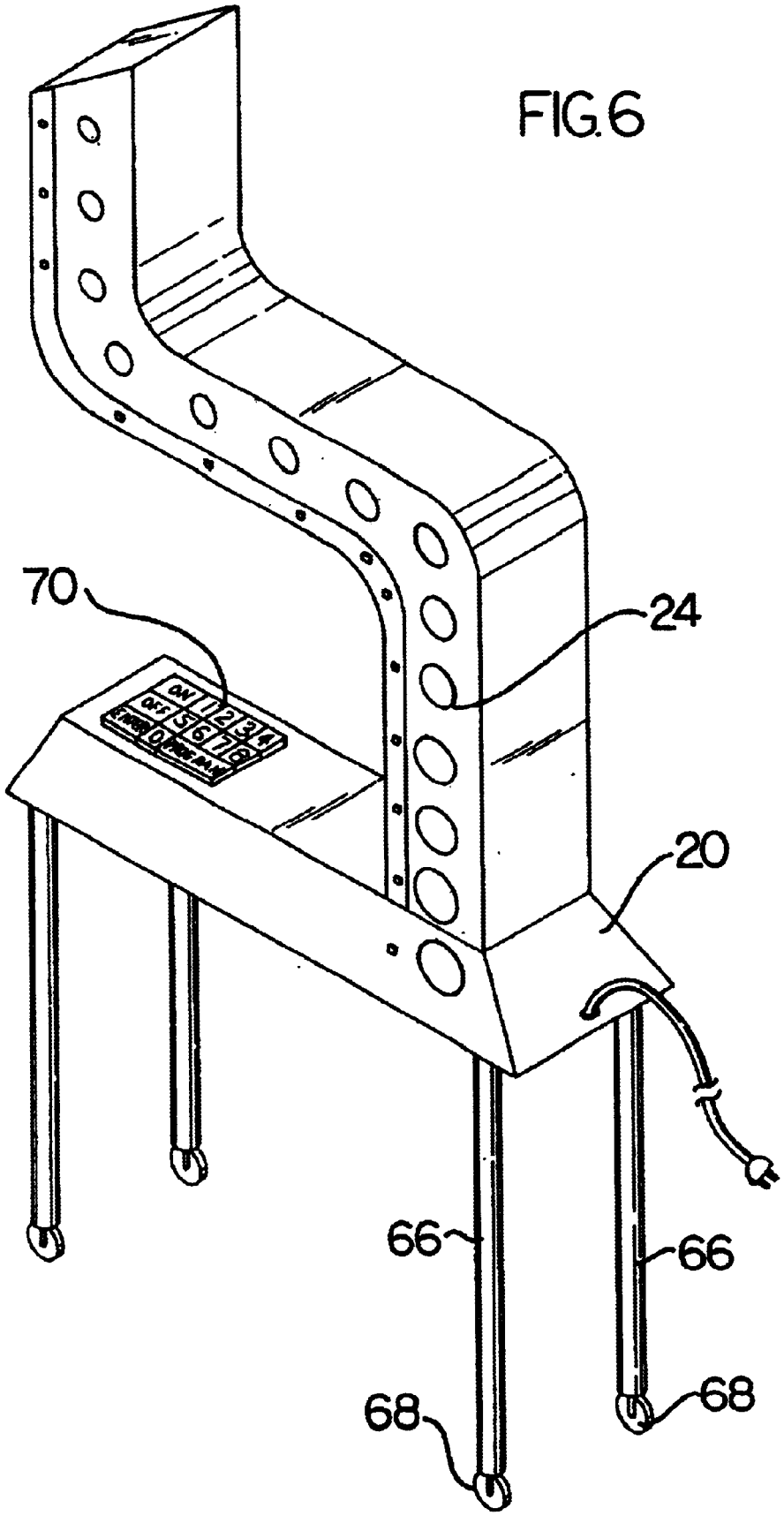
FIG. 6 is a schematic perspective view of an alternate embodiment of the present invention.

With reference now to the drawings, and in particular to FIGS. 1 through 6 thereof, a new cordless curling iron heating system embodying the principles and concepts of the present invention and generally designated by the reference numeral 10 will be described.

As best illustrated in FIGS. 1 through 6, the cordless curling iron heating system 10 generally comprises a housing 20, a plurality of heating elements 40, and a plurality of cordless curling irons 60.

The housing 20 includes a base portion 22 and a plurality of curling iron sockets 24. Each of the heating elements 40 is coupled to an associated one of the plurality of curling iron sockets 24 for heating the associated curling iron socket 24. Each of the cordless curling irons 60 is insertable into a desired one of the curling iron sockets 24. Thus, each of the cordless curling irons 60 is heatable by insertion into the desired one of the curling iron sockets 24.

A plurality of suction cups 26 may be coupled to an underside of the base portion 22. Thus, the base portion 22 is designed for being secured to a support surface using the suction cups 26. In an alternate embodiment shown in FIG. 6, legs 66 extend from the underside of the base portion. Wheels 68 are positioned on the end of legs 66 to facilitate movement of the device on a support surface.

A power source 42 is preferably operationally coupled to each of the heating elements 40. Additionally, each of a plurality of on/off switches 44 is operationally coupled between the power source 42 and an associated one of the plurality of heating elements 40. Thus, each on/off switch 44 permits heating of the associated heating element 40 when the on/off switch 44 is in a first position and prevents heating of the associated heating element 40 when the on/off switch 44 is in a second position.

A plurality of indicators 46 may be coupled to the housing 20. Each of the indicators 46 is operationally coupled to an associated one of the heating elements 40 such that the indicator 46 is activated when the associated heating element 40 is activated.

In an embodiment the indicators 46 are arranged into a display panel on an upper surface of the base portion 22 of the housing 20.

The housing 20 also includes a main portion 30. Each of the plurality of curling iron sockets 24 is positioned in the main portion 30. The main portion 30 includes a substantially vertical lower portion 32, a substantially vertical upper portion 34, and an offset portion 36, extending between the lower 32 and upper portions 34.

In a further embodiment the plurality of curling iron sockets 24 is thirteen curling iron sockets 24. Each of the curling iron sockets 24 includes a unique diameter relative to each other curling iron socket 24.

In still a further embodiment the plurality of curling irons 60 is thirteen curling irons 60. Each of the curling irons 60 includes a heating portion 62. The heating portion 62 of each of the curling irons 60 includes a unique diameter relative to the heating portion of each other curling iron 60.

A microcontroller 38 is preferably coupled to the housing 20. The microcontroller 38 is operationally coupled to each of the heating elements 40.

Each of a plurality of thermostats 48 is operationally coupled to an associated one of the heating elements 40 and the microcontroller 38 for preventing overheating of each of the heating elements 40.

In still yet a further embodiment, a liquid crystal display panel 50 may be operationally coupled to the microcontroller 38 for indicating which of the plurality of heating elements 40 is activated.

In still another embodiment, a keypad 70 is positioned on the upper surface of the base portion of the housing. The keypad is operationally coupled to each of the heating elements to permit manual control of the heating elements through use of keypad 70.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cordless curling iron heating system comprising:

a housing having a plurality of curling iron sockets:

a plurality of heating elements, each of said heating elements being coupled to an associated one of said plurality of curling iron sockets for heating said associated curling iron socket;

a plurality of cordless curling irons, each of said cordless curling irons being insertable into a desired one of said curling iron sockets whereby each of said cordless curling irons is heatable by insertion into said desired one of said curling iron sockets;

a microcontroller coupled to said housing, said microcontroller being operationally coupled to each of said heating elements; and a plurality of thermostats, each of said thermostats being operationally coupled to an associated one of said heating elements and said microcontroller for preventing overheating of each of said heating elements.

2. The cordless curling iron heating system of claim 1, further comprising:

said housing having a base portion;

a plurality of suction cups coupled to an underside of said base portion whereby said base portion is adapted for securement to a support surface using said suction cups.

3. The cordless curling iron heating system of claim 1, further comprising:

a power source operationally coupled to each of said heating elements;

a plurality of on/off switches, each of said on/off switches being operationally coupled between said power source and an associated one of said plurality of heating elements whereby each on/off switch permits heating of said associated heating element when said on/off switch is in a first position and prevents heating of said associated heating element when said on/off switch is in a second position.

4. The cordless curling iron heating system of claim 1, further comprising:

a plurality of indicators coupled to said housing, each of said indicators being operationally coupled to an associated one of said heating elements such that said indicator is activated when said associated heating element is activated.

5. The cordless curling iron heating system of claim 4, further comprising:

said housing having a base portion;

said indicators being arranged into a display panel on an upper surface of said base portion of said housing.

6. The cordless curling iron heating system of claim 1, further comprising:

said housing having a main portion, each of said plurality of curling iron sockets being positioned in said main portion;

said main portion having a substantially vertical lower portion a substantially vertical upper portion, and an offset portion extending between said lower and upper portions.

7. The cordless curling iron heating system of claim 1, further comprising:

a liquid crystal display panel operationally coupled to said microcontroller for indicating which of said plurality of heating elements is activated.

8. The cordless curling iron heating system of claim 1 further comprising:

a plurality of legs extending from said housing for supporting said housing over a support surface.

9. The cordless curling iron heating system of claim 8 further comprising:

a plurality of wheels, each wheel being positioned at a lower end of an associated one of said legs for facilitating movement of said housing over the support surface.

10. The cordless curling iron heating system of claim 1 further comprising:

a keypad positioned on said housing, said keypad being operationally coupled to each of said heating elements for permitting manual control of said heating elements using said keypad.

11. A cordless curling iron heating system comprising:

a housing having a plurality of curling iron sockets;

a plurality of heating elements, each of said heating elements being coupled to an associated one of said plurality of curling iron sockets for heating said associated curling iron socket;

a plurality of cordless curling irons, each of said cordless curling irons being insertable into a desired one of said curling iron sockets whereby each of said cordless curling irons is heatable by insertion into said desired one of said curling iron sockets;

said plurality of curling iron sockets being thirteen curling iron sockets, each of said curling iron sockets having a unique diameter relative to each other curling iron socket; and said plurality of curling irons being thirteen curling irons, each of said curling irons having a heating portion, said heating portion of each of said curling irons having a unique diameter relative to said heating portion of each other curling iron.

12. A cordless curling iron heating system comprising:

a housing having a base portion and a plurality of curling iron sockets;

a plurality of heating elements, each of said heating elements being coupled to an associated one of said plurality of curling iron sockets for heating said associated curling iron socket;

a plurality of cordless curling irons, each of said cordless curling irons being insertable into a desired one of said curling iron sockets whereby each of said cordless curling irons is heatable by insertion into said desired one of said curling iron sockets;

a plurality of suction cups coupled to an underside of said base portion whereby said base portion is adapted for securement to a support surface using said suction cups;

a power source operationally coupled to each of said heating elements;

a plurality of on/off switches, each of said on/off switches being operationally coupled between said power source and an associated one of said plurality of heating elements whereby each on/off switch permits heating of said associated heating element when said on/off switch is in a first position and prevents heating of said associated heating element when said on/off switch is in a second position;

a plurality of indicators coupled to said housing, each of said indicators being operationally coupled to an associated one of said heating elements such that said indicator is activated when said associated heating element is activated;

wherein said indicators being arranged into a display panel on an upper surface of said base portion of said housing;

said housing having a main portion, each of said plurality of curling iron sockets being positioned in said main portion;

said main portion having a substantially vertical lower portion a substantially vertical upper portion, and an offset portion extending between said lower and upper portions;

wherein said plurality of curling iron sockets being thirteen curling iron sockets, each of said curling iron sockets having a unique diameter relative to each other curling iron socket;

wherein said plurality of curling irons being thirteen curling irons. each of said curling irons having a heating portion, said heating portion of each of said curling irons having a unique diameter relative to said heating portion of each other curling iron;

a microcontroller coupled to said housing, said microcontroller being operationally coupled to each of said heating elements;

a plurality of thermostats, each of said thermostats being operationally coupled to an associated one of said heating elements and said microcontroller for preventing overheating of each of said heating elements; and a liquid crystal display panel operationally coupled to said microcontroller for indicating which of said plurality of heating elements is activated.

* * * * *